US006793615B2

(12) United States Patent
South et al.

(10) Patent No.: US 6,793,615 B2
(45) Date of Patent: Sep. 21, 2004

(54) INTERNAL SEAL FOR A DISPOSABLE CENTRIFUGE

(75) Inventors: Kevin C. South, Cookeville, TN (US); Peter K. Herman, Cookeville, TN (US); Hendrik N. Amirkhanian, Cookeville, TN (US); Ismail C. Bagci, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 86 days.

(21) Appl. No.: 10/084,039

(22) Filed: Feb. 27, 2002

(65) Prior Publication Data

US 2003/0162645 A1 Aug. 28, 2003

(51) Int. Cl.[7] ..... B04B 9/06
(52) U.S. Cl. ..... 494/38; 494/49
(58) Field of Search ..... 494/38, 43, 49, 494/64, 85, 901

(56) References Cited

U.S. PATENT DOCUMENTS

| | | | | |
|---|---|---|---|---|
| 2,335,420 A | | 11/1943 | Jones | |
| 3,169,678 A | * | 2/1965 | Wilkinson | |
| 3,987,927 A | * | 10/1976 | Serr et al. | |
| 4,221,323 A | | 9/1980 | Courtot | |
| 4,787,975 A | | 11/1988 | Purvey | 210/360.1 |
| 4,871,458 A | * | 10/1989 | Purvey | 494/49 |
| 4,911,833 A | | 3/1990 | Schoendorfer et al. | 210/167 |
| 4,930,412 A | | 6/1990 | Stroucken | 494/70 |
| 4,943,273 A | | 7/1990 | Pages | 494/41 |
| 5,052,996 A | | 10/1991 | Lantz | 494/68 |
| 5,405,308 A | | 4/1995 | Headley et al. | 494/67 |
| 5,549,821 A | | 8/1996 | Bounnakhom et al. | 210/232 |
| 5,637,217 A | | 6/1997 | Herman et al. | 210/380.1 |
| 5,795,477 A | * | 8/1998 | Herman et al. | 494/49 |
| 6,017,300 A | | 1/2000 | Herman | 494/49 |
| 6,019,717 A | | 2/2000 | Herman | 494/49 |
| 6,074,336 A | * | 6/2000 | Purvey | 494/49 |
| 6,183,407 B1 | | 2/2001 | Hallgren et al. | 494/49 |
| 6,196,962 B1 | | 3/2001 | Purvey et al. | 494/49 |
| 6,213,928 B1 | * | 4/2001 | Joshi et al. | 494/10 |
| 6,224,531 B1 | | 5/2001 | Frehland et al. | 494/49 |
| 2001/0016549 A1 | * | 8/2001 | Herman et al. | 494/49 |
| 2002/0049126 A1 | * | 4/2002 | Herman et al. | 494/75 |
| 2002/0119883 A1 | * | 8/2002 | Herman et al. | 494/75 |

FOREIGN PATENT DOCUMENTS

| | | | | |
|---|---|---|---|---|
| GB | 2 049 494 A | | 12/1980 | B04B/7/08 |
| GB | 2302049 | * | 1/1997 | |
| WO | WO 92/16303 | | 10/1992 | B04B/9/06 |
| WO | WO 98/46361 | | 10/1998 | B04B/5/00 |

* cited by examiner

*Primary Examiner*—Charles E. Cooley
(74) *Attorney, Agent, or Firm*—Woodard, Emhardt, Moriarty, McNett & Henry LLP

(57) ABSTRACT

A fluid separation centrifuge for the separation of particulate matter from a flow of oil is designed with a disposable rotor assembly including a molded plastic rotor housing and a fluid separation device positioned within the rotor housing. Included as part of the fluid separation device is a unitary, molded plastic base plate which is designed and arranged with a peripheral lip formed with a channel portion therein. In a cooperating manner, the rotor housing is constructed and arranged with a molded plastic, generally cylindrical projection which is designed and arranged to receive the channel portion so as to create a fluid-tight, sealed interface at the location of contact between the projection and the channel portion.

14 Claims, 7 Drawing Sheets

INTERNAL SEAL FOR A DISPOSABLE CENTRIFUGE

BACKGROUND OF THE INVENTION

The present invention relates in general to fluid separation centrifuges which are designed to separate particulate matter from a fluid which circulates through the centrifuge. More specifically, the present invention relates to a disposable centrifuge rotor with an internal seal. The internal seal is provided in order to help retain collected soot and ultra-fine particles of 0.01 to 1.0 microns in size in the intended collection zone.

While the present invention is believed to have broad applicability to disposable centrifuge rotors, it is described in the context of two specific centrifugal rotor designs. One design selected is a current product of Fleetguard, Inc. of Nashville, Tenn., offered under part number CS41000. The other design is a split-flow centrifuge.

The current CS41000 centrifuge rotor was designed to have a base plate that mates to an inner ring on the inside of the bottom rotor housing. The mating interfit between the parts creates a circumferential line-to-line contact. With this design, the CS41000 product demonstrates excellent performance for the collection of dust in the size range of 3 to 80 microns. However, it was learned that the performance of the CS41000 centrifugal rotor was not as efficient for soot collection for particulate in the size range of 0.01 to 1.0 microns. This change in performance was ultimately attributed to a pressure gradient and fluid leakage between the base plate and rotor housing.

Analysis of the flow and separation efficiency of centrifuges, by means of computational fluid dynamics (CFD) modeling software, applied to various centrifuge designs, indicated that a substantial pressure gradient existed across the base plate. It was concluded that this substantial pressure gradient in turn caused a leakage flow between the rotor housing and the base plate at their circumferential interface (i.e., contact) location. It was thought that the substantial pressure gradient caused some deflection in the base plate that contributed to the leakage flow across this interface location.

In order to further analyze the nature of the flow and the effects of leakage at the rotor housing-base plate interface, a split-flow centrifuge was selected and modified to have a predefined 0.5 mm gap. It was learned that the flow actually becomes reversed from the desired condition. More specifically, it was learned that the "driving fluid" (exiting from a bottom port on the shaft), which is supposed to stay below the base plate and go directly to the jet nozzle outlets, is actually re-routed up through spiral vane outlet holes where only the "through-flow" portion (from a top port on the shaft) is supposed to be exiting. Both the through-flow and driving fluid then pass through the "leak" annulus before proceeding to the jet nozzle outlets. This leakage, and more specifically the associated flow, causes a large increase in the degree of fluid motion, especially in the critical area near the outer wall of the rotor housing which is designed as the sludge/soot collection zone for the rotor. This increased fluid motion causes some of the separated soot to be "washed out" of the collection zone, a result which is highly undesirable. The problem increases in severity as rotor speed increases. The amount of separated sludge (or soot) from that residing in the collection zone which is then re-entrained into the flow depends in part on the degree of leakage at the rotor housing-base plate interface.

In order to address this concern, the present invention was conceived and reduced to practice as a working model. Testing with the working model confirmed the viability and value of the present invention as a way to address the aforementioned problem of leakage at the rotor housing-base plate interface.

Prior to arriving at the present invention, a number of sealants were tried as a way to fix the leakage problem. However, the large pressure gradient which is experienced by the base plate caused the base plate to deflect and this pulled the sealant loose and opened a leakage path.

The present invention creates a cylindrical surface-to-cylindrical surface contact between the base plate and the bottom portion of the rotor housing. In one embodiment this surface contact is achieved by the addition of a U-clip lip on the outer peripheral edge of the base plate. This inverted U-clip lip interlocks with an upwardly extending cylindrical projection which is integral with the rotor housing. This interlocking relationship, by an interference fit, ensures that the base plate does not experience any deflections which are sufficient to open up a fluid leakage path. In other embodiment, this surface contact is achieved by adding an upwardly extending cylindrical wall on the outer peripheral edge of the base plate. The same upwardly extending cylindrical projection of the rotor housing is used. The cylindrical wall and the cylindrical projection are in tight contact and spin welded together into a sealed interface. For the first embodiment using the U-clip, the present invention can also accept the use of a sealant such as one of the anaerobic compounds or a silicon-based material for an even more robust seal, if desired.

SUMMARY OF THE INVENTION

A separation centrifuge for the separation of particulate matter from a fluid according to one embodiment of the present invention includes a rotor housing and a fluid separation device positioned within the rotor housing wherein the improvement comprises a base plate as part of the fluid separation device which is designed and arranged with a peripheral lip which is formed with a generally cylindrical modified portion therein. A generally cylindrical projection as part of the rotor housing is designed and arranged to contact the modified portion so as to create a generally cylindrical sealed interface at the location of circumferential contact between the projection and the modified portion.

One object of the present invention is to provide an improved rotor assembly for a fluid separation centrifuge.

Related objects and advantages of the present invention will be apparent from the following description.

DESCRIPTION OF THE PREFERRED EMBODIMENTS

Figure 1:
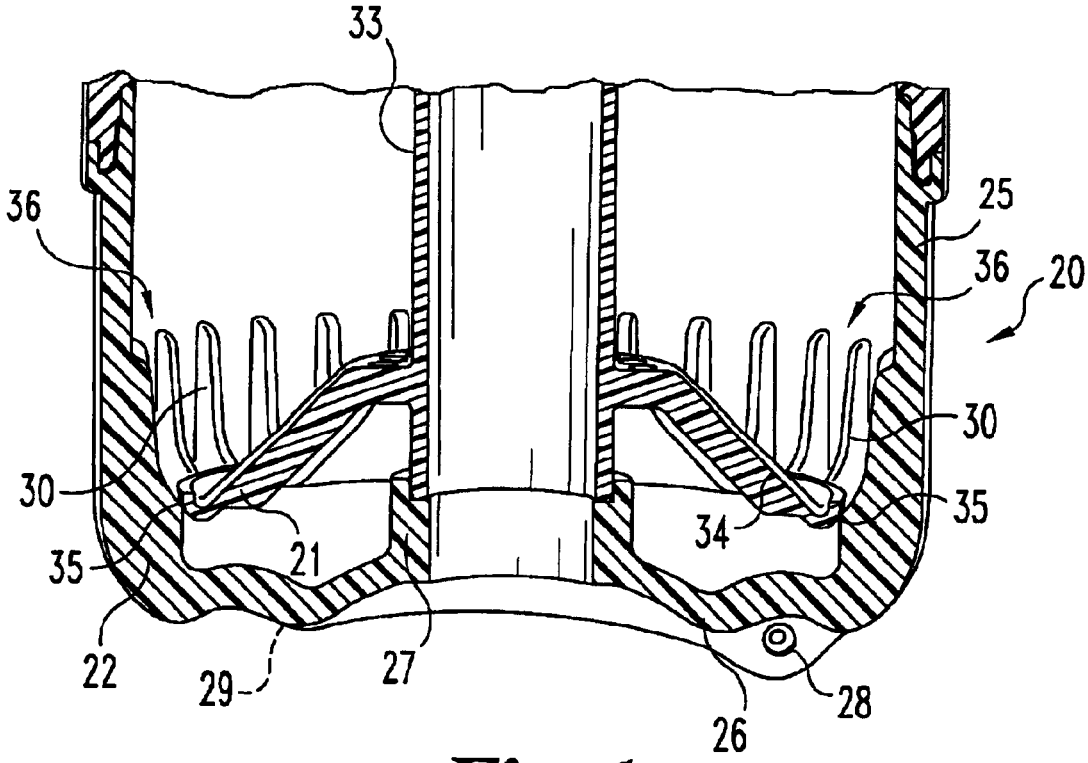
Fig. 1 (PRIOR ART)
FIG. 1 is a partial, front elevational view, in full section, of a base plate and rotor housing assembly for illustrative purposes of a "prior art" design.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated in partial form a rotor housing and base plate assembly 20 for a particle separation centrifuge. Since the present invention is directed to the interface region of the base plate 21 and bottom portion of the rotor housing 22, only the relevant portion of the assembly 20 is illustrated for this purpose. The FIG. 1 illustration depicts the "prior art" design, prior to incorporation of the present invention.

The rotor housing 22 includes an integral sidewall 25 and base 26 with an integral (hollow) hub 27 which is generally centered in the base and generally concentric with the sidewall. The base also defines a pair of jet nozzles 28, 29 which provide rotary motion by the outflow of fluid resulting from centrifuge operation. A series of stiffening ribs 30, integral with the sidewall, are equally spaced around hub 27.

A particle separation subassembly (not illustrated) is housed within the rotor housing for processing the fluid flowing therethrough. Base plate 21 is the cooperating lower plate portion of that particle separation subassembly. Base plate 21 includes a centertube 33 which fits into hub 27 and extends for substantially the full length (or height) of the rotor housing 22, in an axial direction. Also included as part of base plate 21 is a base plate shelf 34 which is integral with centertube 33 and has the shape and geometry as illustrated. Shelf 34 extends in a radially outwardly direction to a point (circumferential line) contact (location 35) against the inner surface of the rotor housing 22. While a point contact is actually illustrated on each side of the rotor housing 22, due to the full section view of FIG. 1, it should be understood that the actual contact between the two parts is intended to be a full 360 degrees of circumferential contact.

During operation of the centrifuge which is partially illustrated in FIG. 1, important design information was learned regarding the ability of the centrifuge to separate different media and particle sizes. Additionally, computational fluid dynamics modeling was used with other centrifuge designs, such as that of FIG. 2, to understand more about the flow dynamics inside the centrifuge. Specifically, it was learned that the "driving fluid" of a split-flow centrifuge which is supposed to stay below the base plate shelf after exiting from a bottom port on the support shaft, and then go directly to the jet nozzles, was instead being re-routed upwardly (specifically through spiral vane outlet holes). This results in a combined flow of the through-flow and driving fluid. Ultimately it was learned that when a centrifuge of the FIG. 1 or FIG. 2 type is used for soot collection (0.01 to 1.0 microns), a substantial pressure gradient exists across the base plate, causing a leakage flow between the rotor housing and the base plate at their circumferential interface.

The combination of these factors means that both the through-flow and driving fluid pass through the leak location before proceeding to the jet nozzles. In turn, this causes a large increase in the degree of fluid motion, especially in the critical area near the sidewall of the rotor housing which constitutes the sludge/soot collection zone 36 for the centrifuge designs of FIG. 1 and FIG. 2. The (undesired) result of this increase in fluid motion is particle re-entrainment. In other words, separated sludge and soot is actually "washed out" of the collection zone 36 and this results in a reduced collection efficiency. This particular problem increases in severity as the rotor speed increases. In an effort to address the described problem, the present invention was conceived and reduced to practice. The actual reduction to practice enabled the (new) centrifuge performance to be modeled using computational fluid dynamics software in order to confirm the improved results.

Figure 1A:
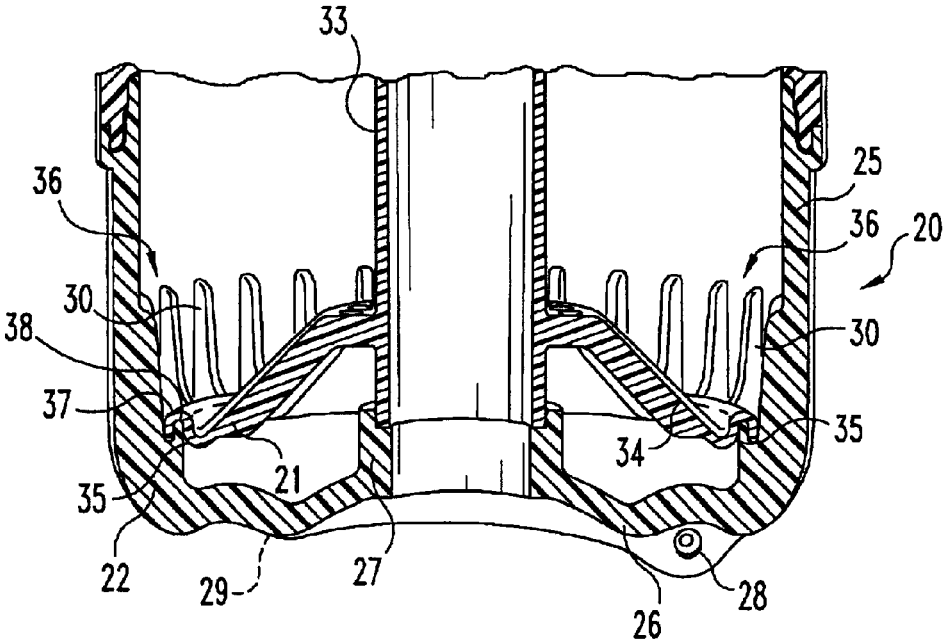
FIG. 1A is a partial, front elevational view, in full section, of an improvement to the FIG. 1 assembly, incorporating a U-clip lip, according to the present invention.
Figure 1B:
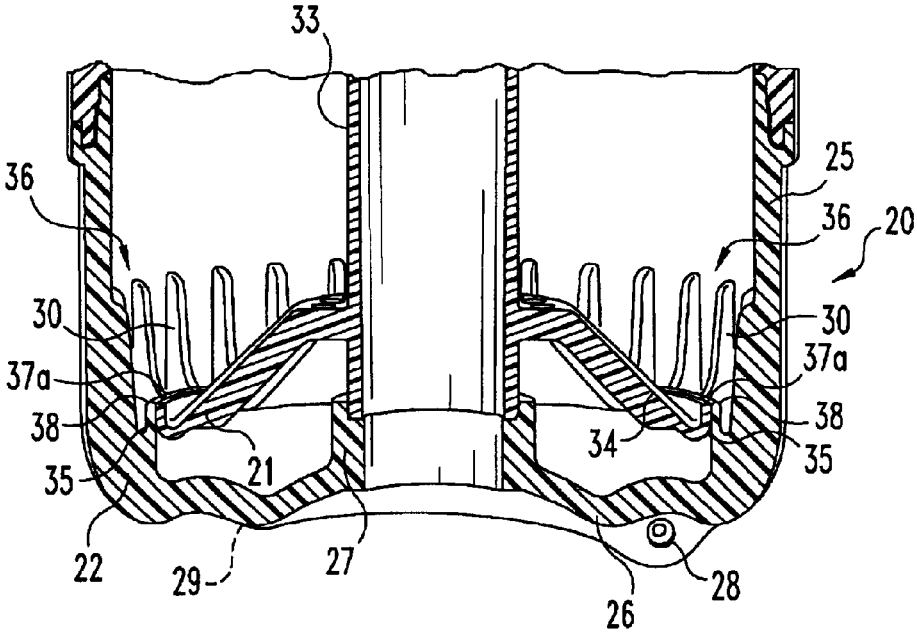
FIG. 1B is a partial, front elevational view, in full section, of an improvement to the FIG. 1 assembly, incorporating a spin welded raised wall, according to the present invention.
Figure 2:
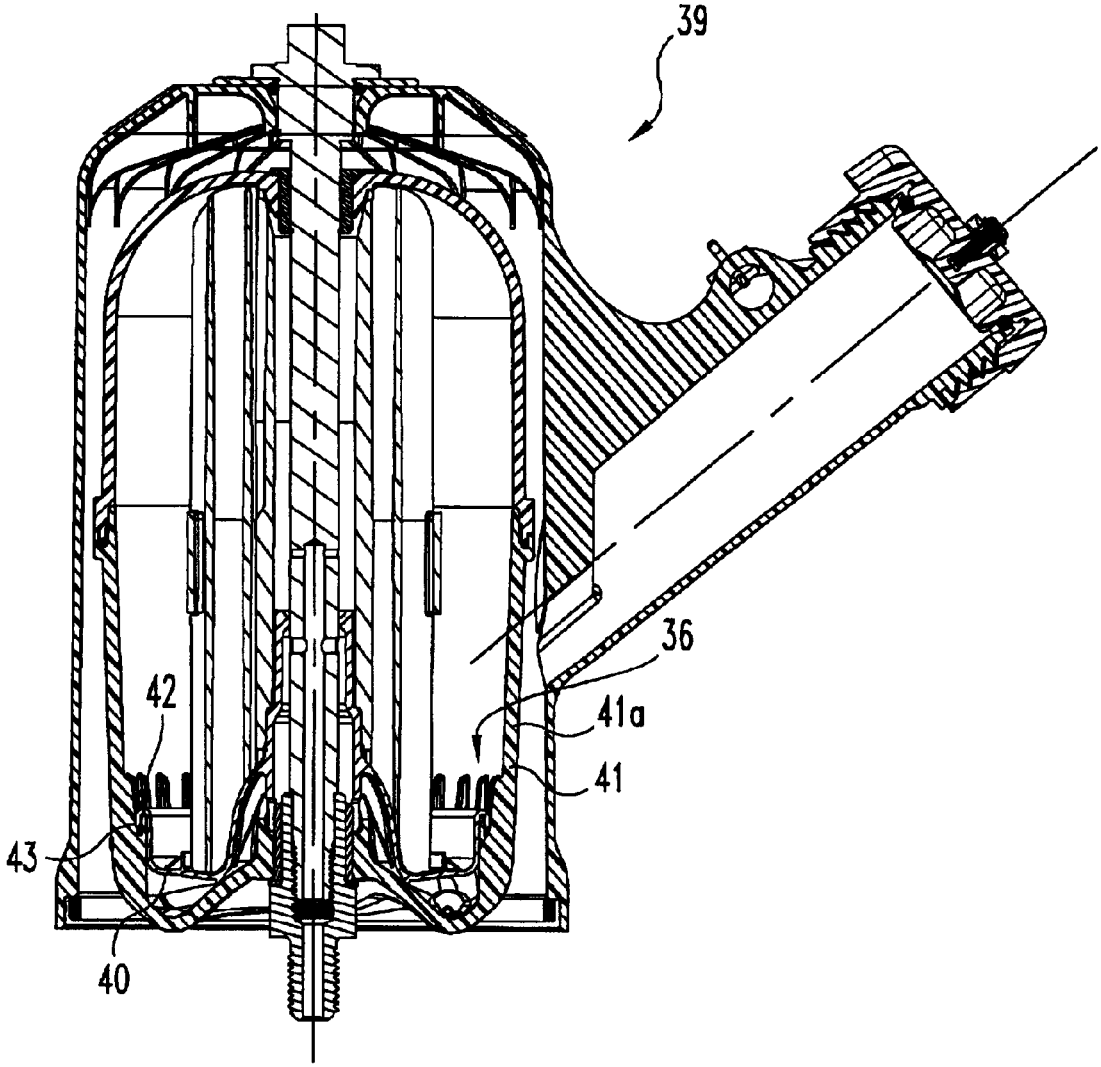
FIG. 2 is a front elevational view, in full section, of a centrifuge assembly incorporating a rotor and base plate subassembly according to the present invention.

Two centrifuge designs have been included to explain the embodiments of the present invention. One centrifuge style is illustrated in FIG. 1 (prior art) and the invention embodiments which constitute improvements to this style of centrifuge are illustrated in FIGS. 1A and 1B. The other centrifuge style (split-flow) is illustrated in FIG. 2. In simple terms, the FIG. 1A embodiment incorporates a modified portion 37 in the form of an inverted U-clip shaped peripheral lip. The cooperating portion of the rotor housing 25 is the upwardly extending, generally cylindrical projection 38. As will be explained in greater detail, in the context of FIGS. 2, 3, 4, and 5, the U-clip lip 37 fits onto projection 38 with an interference fit. This interference fit creates a circumferential sealed interface at what was leak location 35 in the FIG. 1 (prior art) centrifuge.

With reference to the FIG. 1B embodiment, the modified portion 37*a* is in the form of a raised, generally cylindrical wall. Wall 37*a* is positioned tightly against the cylindrical projection 38 with an axial height generally matching that of cylindrical projection 38. There is accordingly a cylindrical surface of contact (circumferential) between wall 37*a* and the inside surface of projection 38. The wall 37*a* and projection 38 are spin welded together in order to create a circumferentially sealed interface at what was leak location 35 in the FIG. 1 (prior art) centrifuge.

Figure 3:
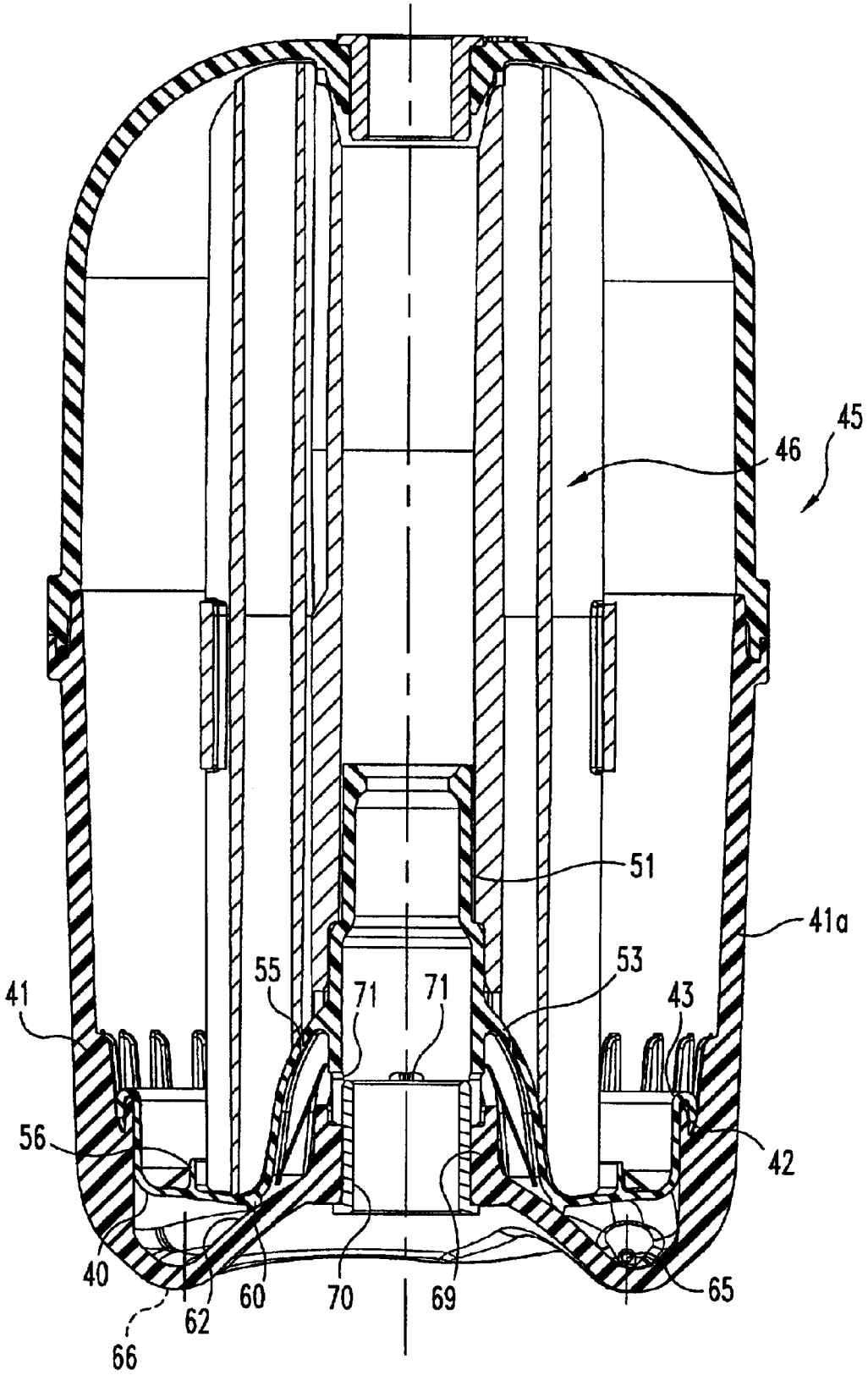
FIG. 3 is an enlarged, front elevational view, in full section, of the rotor and base plate subassembly illustrated in FIG. 2.

With reference to FIGS. 2 and 3, a new base plate 40 (see FIGS. 4 and 5) is illustrated in assembled combination with a new rotor housing 41 (bottom portion only) as part of separation centrifuge 39 according to the present invention. The FIG. 3 rotor assembly 45 which includes the rotor housing 41, fluid separation device 46, and base plate 40 is designed to be a disposable assembly. In this context, the concept of "disposable" is directed to the materials which are used and the overall design from a cost perspective. The housing 41 is fabricated as two sections and each section is a unitary molded plastic member. The base plate 40 is also a unitary, molded plastic member. While a comparison between FIG. 1 and FIGS. 2 and 3 will reveal numerous structural changes to the rotor housing 41 and to the base plate 40, a number of these contribute primarily to the overall rigidity of the base plate and the overall interfit between the base plate 40 and the rotor housing 41. However, the most significant change to the rotor housing 41 and, in part, the focus of the present invention, is the addition of a substantially cylindrical projection 42 which is upwardly extending and located around the inside surface of the rotor housing wall. The cylindrical projection 42 is in close proximity to the rotor housing wall 41*a*, but is spaced therefrom so that there is clearance on both sides of the projection. Additionally, the cylindrical projection 42 is positioned in close proximity to what was previously (referring to the FIG. 1 assembly) leakage location 35. In a cooperating fashion, the most significant change to the design of the base plate 40 is the addition of an inverted U-clip lip 43 which is located adjacent the outer peripheral edge of base plate 40. As used in this paragraph "most significant" refers to the new features which have the greatest effect on solving the fluid leakage problem described in the context of the FIG. 1 centrifuge.

As illustrated, the U-clip lip 43 fits onto and over the upper edge of the cylindrical projection 42. The inverted channel 43*a* which is characteristic of the lateral cross sectional shape of the U-clip lip 43 includes opposing sidewalls and these become positioned in the clearance spaces on opposite sides of cylindrical projection 42. The width of the U-clip lip 43 channel 43*a* is sized relative to the radial thickness of the cylindrical projection 42 so as to ensure an interference fit of the U-clip lip 43 onto the cylindrical projection 42.

In addition to the described interference fit, it is contemplated that an anaerobic curing compound or silicon sealant can be dispensed into the channel portion 43*a* of the inverted U-clip lip 43 prior to assembly, providing an even more robust seal. Alternatively, a modified form of the base plate 40 can be spin welded to the cylindrical projection 42 of the rotor housing 41 to ensure that a permanent mechanical seal is established between these two parts at the critical interface location. This modified form is illustrated in FIGS. 3A and 4A.

Figure 3A:
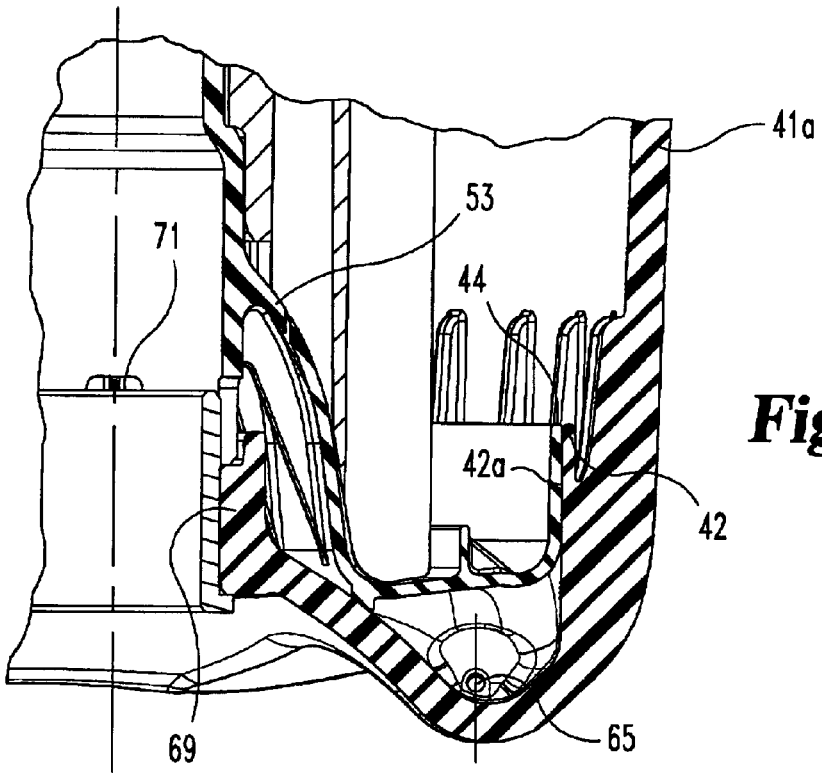
FIG. 3A is an enlarged, front elevational view, in full section, of an alternate embodiment to the FIG. 3 subassembly, incorporating a spin welded raised wall.
Figure 4A:
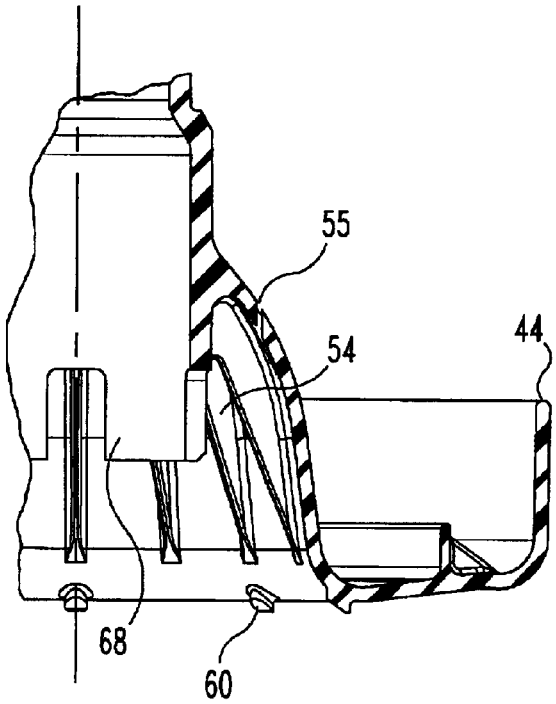
FIG. 4A is an additional drawing illustration of the FIG. 3A alternate embodiment according to the present invention.

An alternate embodiment of the present invention of FIGS. 2 and 3 (including FIGS. 4 and 5) is illustrated in FIGS. 3A and 4A. This is the modified form of the base plate where the U-clip lip 43 is replaced by an upwardly extending, generally cylindrical wall 44. Wall 44 is sized so as to fit tightly up against the inside cylindrical surface 42*a* of projection 42 of the rotor housing. The sealing technique between wall 44 and surface 42*a* involves a spin welding procedure and this replaces the U-clip lip interference fit onto projection 42. This particular embodiment is similar to what was illustrated and described for FIG. 1B.

Returning to FIGS. 2 and 3, the result of the fluid-tight fit between the cylindrical projection 42 and the inverted U-clip (lip) 43, specifically the channel portion 43*a*, is to prevent leakage flow through this circumferential interface (formerly, leak location 35). The same is true for the embodiment of FIG. 3A. By preventing leakage at this location, the sludge/soot collection zone is not "disturbed" and soot which has already been separated out of the fluid flowing into the centrifuge for processing is not re-entrained back into the fluid. The design of the present invention thus solves the problem associated with the earlier base plate configuration which did not securely interfit with the rotor housing wall.

Figure 4:
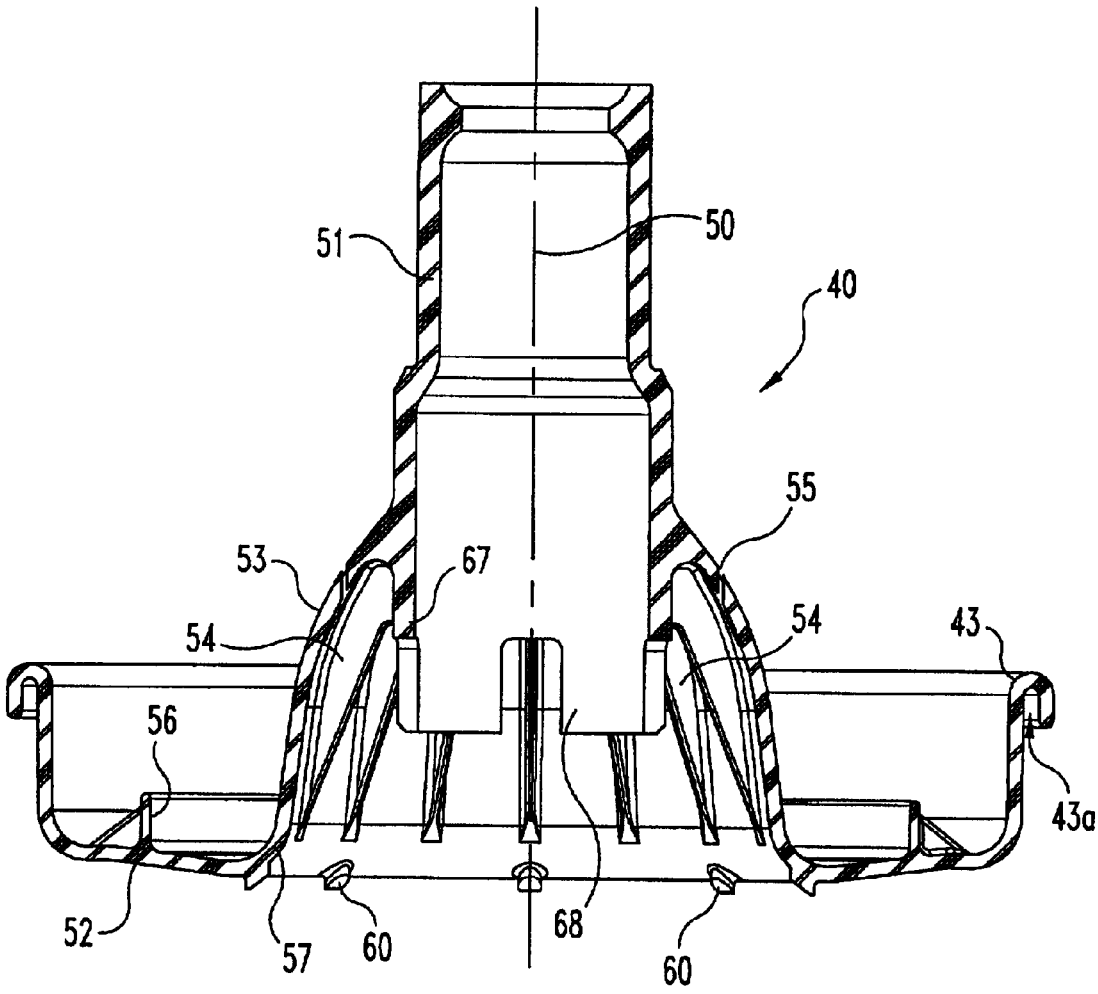
FIG. 4 is an enlarged, front elevational view, in full section, of the base plate of the FIG. 3 assembly.
Figure 5:
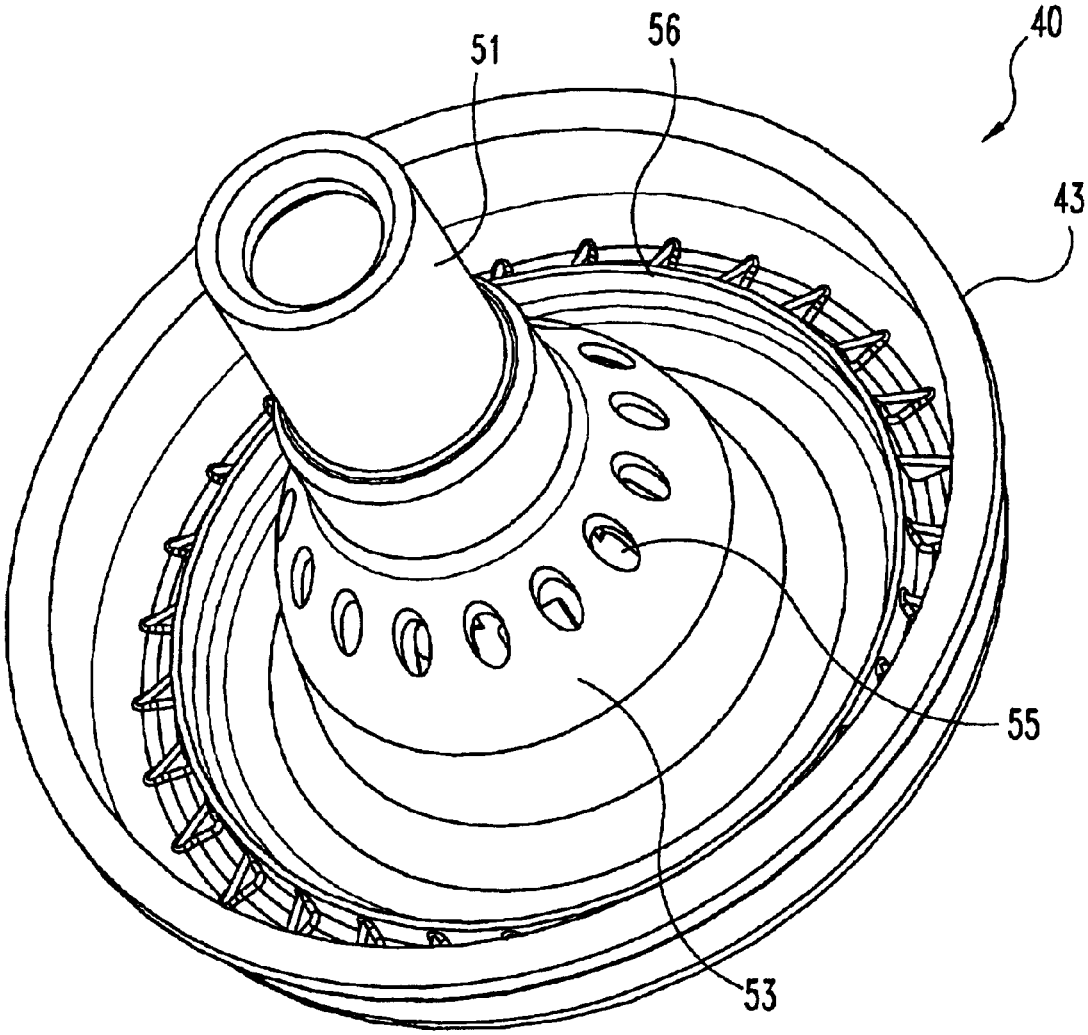
FIG. 5 is a perspective view of the FIG. 4 base plate.

With reference to FIGS. 4 and 5, the structural details of the new base plate 40 according to the present invention are illustrated. Base plate 40 is an integrally molded plastic component which can best be described as being circumferentially symmetrical about longitudinal axis line 50. Longitudinal axis line 50 is coincident with the axis of rotation of the rotor assembly 45.

Included as part of base plate 40, in addition to the U-clip lip 43 and channel 43*a*, is a tubular hub 51, annular lower wall 52, annular curved wall 53, stiffening ribs 54, flow apertures 55, and annular short wall 56. Also included as part of lower wall 52 is a curved section 57 extending between the short wall 56 and the curved wall 53.

On the convex side of curved section 57 a series of spacers 60 are located and are equally spaced apart and integral with curved section 57. The exposed face 61 of each spacer 60 has a curvature which matches the curvature of the curved wall section 62 of the base portion of rotor housing 41. The recessed clearance between each adjacent pair of spacers 60 provides a flow path for fluid to reach the two jet nozzles 65 and 66 (see FIG. 3).

With continued reference to the FIG. 3 assembly, the tubular hub 51 includes a lower end 67 which is notched with clearance spaces in order to create four insertion tabs 68. Each of the four insertion tabs 68 is designed to fit (be inserted) between the rotor housing hub 69 and sleeve bearing 70, as illustrated. The four small clearance holes 71, which are left provide flow paths for the incoming driving fluid.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fluid separation centrifuge for the separation of particulate matter from a fluid comprising:

a rotor housing including a housing wall; and a base plate for a fluid separation device positioned within said rotor housing, wherein the improvement comprises:

said base plate being designed and arranged with a peripheral lip formed with a generally cylindrical modified portion therein, said modified portion having a lateral cross sectional shape which is U-shaped; and said rotor housing including a generally cylindrical projection spaced inwardly from said housing wall and which is designed and arranged to contact said modified portion so as to create a generally cylindrical sealed interface at the location of circumferential contact between said projection and said modified portion.

2. The fluid separation centrifuge of claim 1 wherein said rotor housing is fabricated out of plastic.

3. The fluid separation centrifuge of claim 2 wherein said rotor assembly is designed and arranged as a disposable rotor assembly.

4. The fluid separation centrifuge of claim 3 which further includes a sealing compound placed between said projection and said modified portion.

5. A fluid separation centrifuge for the separation of particulate matter from a fluid comprising:

a rotor housing including a housing wall; and a support plate comprising one portion of a fluid separation device positioned within said rotor housing wherein the improvement comprises:

said support plate defining an annular receiving channel having a lateral cross sectional shape which is U-shaped; and a raised, substantially cylindrical projection comprising one portion of said rotor housing and being spaced inwardly from said housing wall, said cylindrical projection being received by said receiving channel with an interference fit for establishing a sealed interface between said projection and said receiving channel.

6. The fluid separation centrifuge of claim 5 wherein said rotor housing is fabricated out of plastic and said projection is in unitary construction with the remainder of said rotor housing.

7. The fluid separation centrifuge of claim 6 wherein said rotor housing is designed and arranged as a disposable component.

8. The fluid separation centrifuge of claim 7 which further includes a sealing compound placed between said projection and said receiving channel.

9. The fluid separation centrifuge of claim 5 wherein said rotor housing is fabricated out of plastic and said projection is in unitary construction with the remainder of said rotor housing.

10. The fluid separation centrifuge of claim 5 wherein said rotor housing is designed and arranged as a disposable component.

11. The fluid separation centrifuge of claim 5 which further includes a sealing compound placed between said projection and said receiving channel.

12. A fluid separation centrifuge for the separation of particulate matter from a fluid comprising:

a rotor housing including a housing wall; and a base plate for a fluid separation device positioned within said rotor housing, wherein the improvement comprises:

said base plate being integral with a centertube and being designed and arranged with a peripheral lip formed with a generally cylindrical wall portion; and said rotor housing including a generally cylindrical projection spaced inwardly from said housing wall and which is designed and arranged with an inside surface for contacting said wall portion so as to create a generally cylindrical sealed interface at the location of circumferential contact between said projection and said wall portion by a spin weld.

13. A fluid separation centrifuge for the separation of particulate matter from a fluid comprising:

a rotor housing including a housing wall; and a base plate for a fluid separation device positioned within said rotor housing, wherein the improvement comprises:

said base plate being integral with a centertube and being designed and arranged with a peripheral lip formed with a generally cylindrical wall portion; and said rotor housing including a generally cylindrical projection spaced inwardly from said housing wall and which is designed and arranged with an inside surface for contacting said wall portion so as to create a generally cylindrical sealed interface at the location of circumferential contact between said projection and said wall portion by an interference fit.

14. A fluid separation centrifuge for the separation of particulate matter from a fluid comprising:

a rotor housing including a housing wall; and a base plate for a fluid separation device positioned within said rotor housing, wherein the improvement comprises:

said base elate being integral with a centertube and being designed and arranged with a peripheral lip formed with a generally cylindrical wall portion; and said rotor housing including a generally cylindrical projection spaced inwardly from said housing wall and which is designed and arranged with an inside surface for contacting said wall portion so as to create a generally cylindrical sealed interface at the location of circumferential contact between said projection and said wall portion by the use of an adhesive.

* * * * *

UNITED STATES PATENT AND TRADEMARK OFFICE

CERTIFICATE OF CORRECTION

PATENT NO. : 6,793,615 B2
DATED : September 21, 2004
INVENTOR(S) : South et al.

It is certified that error appears in the above-identified patent and that said Letters Patent is hereby corrected as shown below:

Column 8,
Line 25, replace “elate” with -- plate --.

Signed and Sealed this

Thirtieth Day of November, 2004

JON W. DUDAS
*Director of the United States Patent and Trademark Office*